US005796029A

United States Patent [19]

Held et al.

[11] Patent Number: 5,796,029

[45] Date of Patent: Aug. 18, 1998

[54] PROXIMITY FUSE/TIME FUSE FOR MISSILES

[75] Inventors: Manfred Held, Aresing; Horst Kaltschmidt, Neubiberg, both of Germany

[73] Assignee: Daimler-Benz Aerospace AG, München, Germany

[21] Appl. No.: 551,062

[22] Filed: Jul. 7, 1995

[30] Foreign Application Priority Data

Aug. 7, 1994 [DE] Germany ..... 44 24 074.0

[51] Int. Cl.[6] ..... F42C 13/02

[52] U.S. Cl. ..... 102/213

[58] Field of Search ..... 102/213, 211, 102/214

[56] References Cited

U.S. PATENT DOCUMENTS

| | | | |
|---|---|---|---|
| 3,670,652 | 6/1972 | Ziemba | 102/214 |
| 3,902,172 | 8/1975 | Weiss et al. | 102/214 |
| 3,924,233 | 12/1975 | Nastronero et al. | 201/213 |
| 4,193,072 | 3/1980 | McKusick | 102/213 |
| 4,709,142 | 11/1987 | Dahl | 250/221 |

FOREIGN PATENT DOCUMENTS

| | | | |
|---|---|---|---|
| 2232232 | 12/1990 | United Kingdom | 102/213 |

*Primary Examiner*—Charles T. Jordan
*Assistant Examiner*—Christopher K. Montgomery
*Attorney, Agent, or Firm*—McGlew and Tuttle

[57] ABSTRACT

A proximity fuse/time fuse, in which the active optical distance sensor switches over to time delay in the case of disturbances occurring at a short distance before meeting the target, such as detonation flash, fog, explosive charge vapor or fireball. The fuse presets the data for the necessary time delay itself from the data of the preceding distance measurements. One exemplary embodiment is described and shown schematically.

8 Claims, 1 Drawing Sheet

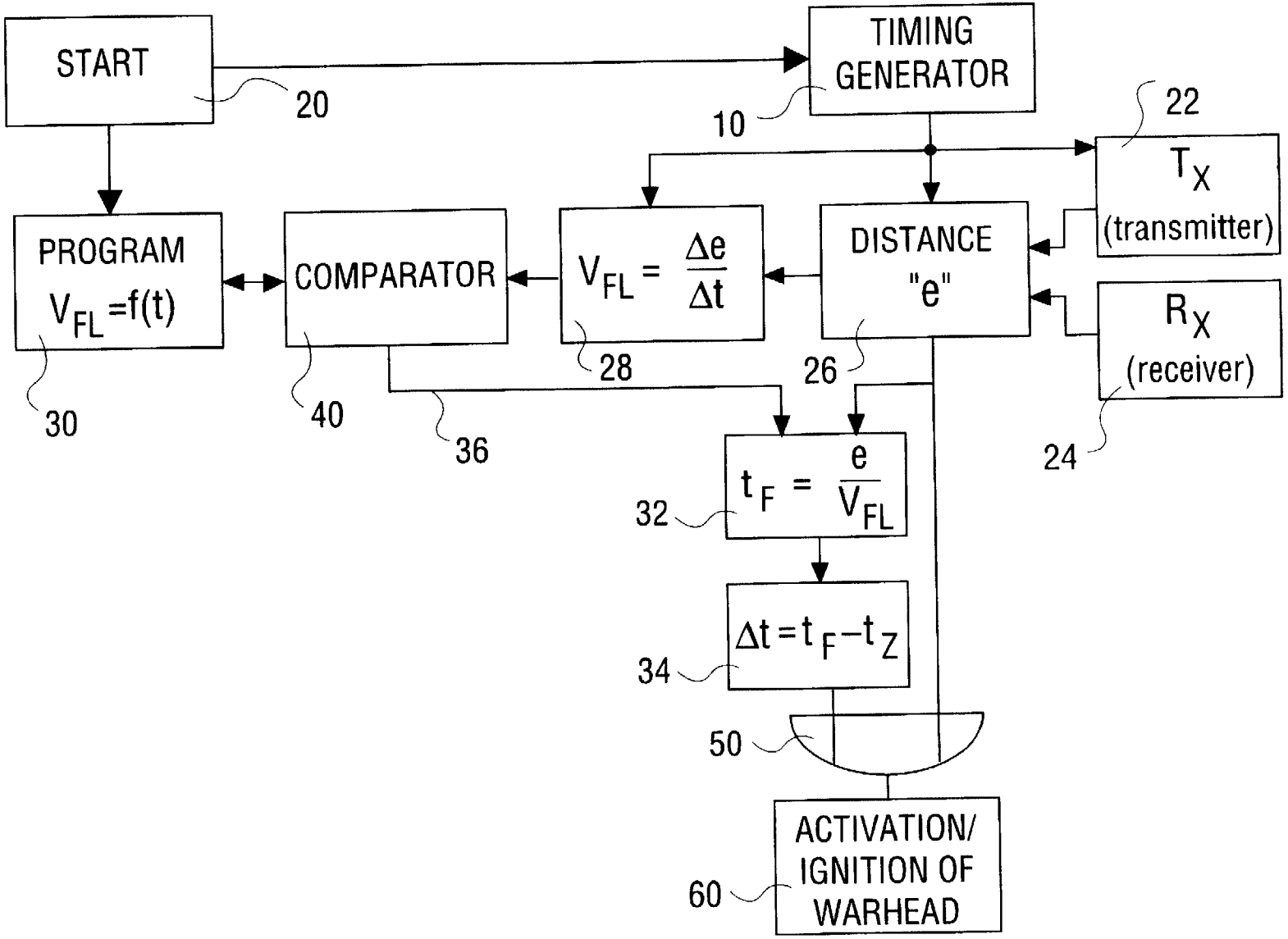
START
20
TIMING GENERATOR
10
$T_X$ (transmitter)
22
$R_X$ (receiver)
24
DISTANCE "e"
26
$V_{FL} = \frac{\Delta e}{\Delta t}$
28
PROGRAM $V_{FL}=f(t)$
30
COMPARATOR
40
36
$t_F = \frac{e}{V_{FL}}$
32
$\Delta t = t_F - t_Z$
34
50
ACTIVATION/ IGNITION OF WARHEAD
60

PROXIMITY FUSE/TIME FUSE FOR MISSILES

FIELD OF THE INVENTION

The present invention pertains to a proximity/time fuse with an optical distance sensor for the distance measurement.

BACKGROUND OF THE INVENTION

Active protection systems have already become known in armored vehicles, which fight and fend off or at least seek to fend off the oncoming hollow charge rockets or antitank guided missiles by means of explosive-accelerated fragments. A very bright detonation flash is generated with such systems due to the detonation of the explosive charge, and this flash initially has a very high luminous density. However, the luminous density decreases very rapidly along with the expansion of the reaction products of the explosive charge and of its vapors.. The luminous intensity does not decrease so rapidly, despite the increasing surface. The actual attack sector of the armored vehicle is completely covered optically by the detonation vapors, or the oncoming antitank rocket or the antitank guided missile passes through this fireball vapor and then hits the target, provided that the attacking missile itself is not destroyed by fragment hits.

Systems have also been known, which currently have optical distance sensors, which can be irradiated by the detonation flash of the weapon system fighting them, and/or their transmitted signals may be absorbed or generally damped in the vapors to the extent that their sensor function is greatly interfered with, if not lost completely. The distance of the missile at the time of the detonation of the fragment charge is in the range of about 5 m. The distance might also hardly be greater than 10 m for reasons of hit probability density.

The optimal distance for the maximum depth performance of hollow charges in relation to the target is between 3 and 6 calibers or, in the case of tandem hollow charges, 3 to 8 and at most 10 calibers. In the case of a missile diameter of 150 mm, this means distances on the order of magnitude of 0.45 to 1.2 m or up to 1.5 m. Furthermore, there are also hollow charge tandem systems with ejectable pre-hollow charges, whose ejection mechanism is triggered (or activated) at distances of a few m. A physical spacer acting as a spike is no longer practicable in these cases, so that nonphysical distance sensors—generally of an optical nature—are used. However, these optical distance sensors lose their function and mode of operation when they enter the fireball vapor of an active protection system. This is also true when a pyrotechnical charge with a very rapidly propagating fog (vapor) is ignited, instead of the detonation of an explosive charge, immediately before the missile reaches the target. This fog may reach distances of many meters.

It may be assumed to be certain that the enemy knows the weapon systems with which he is being fought against, and he selects his defensive measures accordingly, be it the ignition of a light flash charge with a correspondingly rapid generation of fog, or the use of a fragmentation grenade.

SUMMARY AND OBJECTS OF THE INVENTION

The primary object of the present invention is to provide a proximity/time fuse of the above-described type, which has an activation circuit even for great distances and remains completely functional even in the case of interference with visibility or smoke-screening.

This object is attained according to the invention by providing proximity fuse/time fuse for missiles with an optical distance sensor for the distance measurement and switching means activated in the case of disturbances or obstacles appearing at a short distance from the target to be hit, for automatically switching the active optical distance sensor over to a time-switching electronic unit. The time-switching electronic unit is associated and linked with said optical distance sensor, wherein the data for the necessary time delay are preset automatically from the data of the preceding distance measurements.

A timing generator, is preferably associated with the electronic starting unit and controls a transmitter/receiver circuit associated with it. The timing generator is energized by the electronic starting unit, and the transmitter/receiver circuit determines the distance "e" from the interval between the transmission of light and the echo return, and it sends these data either to a comparator for determining the approach velocity $v_{FL}$ or to the electronic unit for the calculation of the flight time $t_F$ to the time of hitting the target.

A time difference $t_D$ is preferably determined from the time of impact $t_F$ minus the ignition time $t_Z$, and it is set to zero to activate/ignite the warhead in a "countdown" cycle.

A critical distance A for the distance measurement is preferably maintained at a slightly greater value than the preset distance A for the time measurement.

The timing generator performs the measurement of the distance "e" by measuring the interval between the transmission of light and the echo return at a cycle frequency on the order of magnitude of 1 msec.

According to the general object of the invention, at the moment at which the proximity fuse ceases to be fully functional at a short distance before the target due to smoke-screening (fog, vapors) or interference with vision, it automatically switches over to time delay, and it presets for itself the data for the necessary time delay in advance from the data of the distance measurement.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only figure is a diagram illustrating the design of a sensor according to the invention and illustrating its mode of operation.

DETAILED DESCRIPTION OF THE PREFERRED EMBODIMENTS

The exemplary embodiment shown in the block diagram illustrates the design of the sensor and its mode of operation. A timing generator 20 is energized at the "start, 20" and the timing generator 10 in turn energizes a transmitter 22 and receiver circuit 24, which determines the distance "e" at distance calculation function 28 in the known manner from the timing of the interval between the transmission of light and the echo return. This timing is now carried out at a cycle frequency of, e.g., 1 msec. The velocity of the missile ($v_{FL}$)

can be accurately determined at 28 from the change in the distance "e" from one or more distances determined one after another at the known time difference Δt:

$$v_{FL}=\Delta e/\Delta t \quad (1)$$

However, this determination of the approach velocity can be abandoned if it is well known per se. It might be designed to be relatively constant due to the cruise engine, or the velocity curve is relatively more or less given as a function of the flight time. This value can also be preset in this case by a velocity preset value as a function of the time, triggered with the start time of the rocket as the zero point. It is either possible to completely do away with the calculation of $v_{FL}$, or this preset value is used for the continuous comparison and compensation of the measurements in a comparator 40. If the measured or calculated flight velocity $v_{FL}$ is in the range of the "possible" velocity, the measured value is subjected to further processing, namely it is supplied at 36 to calculate $t_F$ (time to impact). If, for whatever reason, it is outside this range, the "preprogrammed" value of $v_{FL}$ 30 is supplied at 36 and is used to calculate $t_F$ (time to impact) for the further processing.

The time $t_F$ until the direct impact at the target can now be calculated at 32 by means of the approach velocity of the missile $v_{FL}$:

$$t_F=e/v_{FL} \quad (2)$$

The desired activation/ignition time $t_Z$ can also be calculated with the missile velocity, with the missile having to be detonated or the ejection mechanism having to the triggered at a distance A before of the target. The activation/ignition time $t_Z$ is calculated from:

$$t_Z=A/v_{FL} \quad (3)$$

The time difference $t_D$ (or Δt) until the activation/ignition can now be determined at 34 in a "countdown" with:

$$t_D=t_F-t_Z \quad (4)$$

wherein this $t_D$ value must become 0.

When $t_D=0$ as determined at 34, the activation/ignition of the warhead is initiated at 60, via logic element 50, unless the activation/ignition of the warhead was triggered before by the distance meter 26 when the desired distance A was reached. In practice, the "distance sensor" is presumably given preference over the "time sensor," i.e., the critical distance A for the distance measurement is kept somewhat greater than the distance A that is preset for the time measurement. This circuit has the advantage that, should a disturbance occur in the sensor during the terminal phase, the time sensor will still initiate, at the correct distance toward the target, the function of the warhead, i.e., the ejection of the pre-hollow charge or the detonation of the pre-hollow charge with a corresponding time delay of the main hollow charge in the case of tandem systems, etc.

While a specific embodiment of the invention has been shown and described in detail to illustrate the application of the principles of the invention, it will be understood that the invention may be embodied otherwise without departing from such principles.

What is claimed is:

1. A proximity fuse/time fuse for missiles, comprising:

an optical distance sensor for forming a distance value, representing flight time until impact, for activation of a warhead;

measured velocity means for forming a measured velocity value based on a change in said distance value over time;

programmed velocity means for holding a programmed velocity value based on one of a preprogrammed velocity value or measured velocity value;

a time delay unit for forming a time value until impact, for activation of a warhead upon the expiration of said time value, said time value being based on said distance value and one of said measured velocity value and said programmed velocity value;

comparator means for comparing said measured velocity value and said programmed velocity value and upon determining either a same value or a difference within a given range, supplying said measured velocity value to said time delay unit and upon determining a difference outside said given range supplying said programmed velocity value to said time delay unit whereby in the case of disturbances or obstacles appearing at a short distance from the target to be hit data for forming said necessary time delay are preset automatically from data of distance measurements made previously by said optical distance sensor.

2. Fuse in accordance with claim 1, further comprising:

a timing generator, which is associated with an electronic starting unit and controls a transmitter/receiver circuit of said optical distance sensor, said timing generator being energized by said electronic starting unit, and said transmitter/receiver circuit determining a distance "e" based on an interval between the transmission of light and the echo return, and said transmitter/receiver circuit sending these data to at least one of said measured velocity means and said time delay unit, for the calculation of said flight time until impact.

3. Fuse in accordance with claim 1 wherein said time delay unit determines a time difference $t_D$ from said flight time until impact $t_F$ minus an ignition time $t_Z$, and said time difference $t_D$ is set to zero to activate the warhead in a "countdown" cycle.

4. Fuse in accordance with claim 2 wherein said time delay unit determines a time difference $t_D$ from said flight time until impact $t_F$ minus an ignition time $t_Z$, and said time difference $t_D$ is set to zero to activate the warhead in a "countdown" cycle.

5. Fuse in accordance with claim 1, wherein said time delay unit maintains a critical distance A for the distance measurement at a slightly greater value than the preset distance A for the time measurement.

6. Fuse in accordance with claim 2, wherein said time delay unit maintains a critical distance A for the distance measurement at a slightly greater value than the preset distance A for the time measurement.

7. Fuse in accordance with claim 3, wherein said time delay unit maintains a critical distance A for the distance measurement at a slightly greater value than the preset distance A for the time measurement.

8. Fuse in accordance with claim 2 said, wherein said timing generator cooperates with said optical distance sensor to perform the measurement of the distance "e" by measuring the interval between the transmission of light and the echo return at a cycle frequency on the order of magnitude of 1 msec.

* * * * *